US008038250B2

(12) United States Patent
Kubo et al.

(10) Patent No.: US 8,038,250 B2
(45) Date of Patent: Oct. 18, 2011

(54) RECORDING DEVICE

(75) Inventors: Tomoyuki Kubo, Nagoya (JP); Hirofumi Kondo, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 737 days.

(21) Appl. No.: 12/019,397

(22) Filed: Jan. 24, 2008

(65) Prior Publication Data

US 2008/0174628 A1 Jul. 24, 2008

(30) Foreign Application Priority Data

Jan. 24, 2007 (JP) ..... 2007-014178

(51) Int. Cl.
*B41J 29/377* (2006.01)

(52) U.S. Cl. ..... 347/18; 347/17

(58) Field of Classification Search ..... None
See application file for complete search history.

(56) References Cited

U.S. PATENT DOCUMENTS

2004/0189730 A1 9/2004 Kubo
2005/0122380 A1* 6/2005 Nakamura et al. ..... 347/65
2006/0219356 A1* 10/2006 Tsumura ..... 156/292

FOREIGN PATENT DOCUMENTS

JP 2004-291342 A 10/2004
JP 2005-313428 A 11/2005
JP 2005-322850 A 11/2005

* cited by examiner

*Primary Examiner* — Matthew Luu
*Assistant Examiner* — Justin Seo
(74) *Attorney, Agent, or Firm* — Baker Botts L.L.P.

(57) ABSTRACT

A recording head where an actuator, a cavity portion and a flexible flat cable are placed one on another is provided in a head holder of a carriage. A drive IC chip is mounted on the flexible flat cable. A bottom plate portion of a first heat sink is in contact with the drive IC chip so as to be thermally conductable, and a side plate portion thereof is disposed in a standing condition. A base end of a second heat sink is in contact, so as to be thermally conductable, with a wiring pattern formed portion of the flexible flat cable between the drive IC chip and the actuator, and a heat dissipating portion of the second heat sink is extended below the bottom plate portion, and a part of the heat dissipating portion is exposed to the outside of the head holder.

6 Claims, 7 Drawing Sheets

RECORDING DEVICE

CROSS-REFERENCE TO RELATED APPLICATIONS

This Nonprovisional application claims priority under 35 U.S.C. §119(a) on Patent Application No. 2007-14178 filed in Japan on Jan. 24, 2007, the entire contents of which are hereby incorporated by reference.

BACKGROUND

The present invention relates to a recording device having a flexible flat cable on which a drive IC chip is mounted.

As an example of an inkjet recording device, Japanese Patent Application Laid-Open No. 2004-291342 discloses a structure in which a head unit including a cavity unit having a plurality of nozzles (recording elements) that jet ink and an actuator (piezoelectric actuator) that causes ink to be jetted from the nozzles by selectively causing a pressure in a plurality of pressure chambers provided so as to be associated with the nozzles is attached to the bottom of a head holder (carriage), and ink cartridges are detachably housed on the upper side. This head holder (carriage) reciprocates in the main scanning direction within the housing of the recording device.

According to Japanese Patent Application Laid-Open No. 2004-291342, a wiring pattern connected to electrodes is formed on a flexible circuit board provided with a driver element (drive IC chip) that drives the actuator. One end of the circuit board is joined to the upper surface of the actuator so as to be electrically connected thereto. A drive pulse signal from a control circuit on the side of the device body is converted into a parallel signal corresponding to the electrodes of the actuator and is also converted into a predetermined voltage value to be outputted to the electrodes through the wiring pattern.

Moreover, Japanese Patent Application Laid-Open No. 2004-291342 discloses a structure in which the horizontal side of a heat sink disposed on the lower surface side of the head holder is in contact with the driver element on the circuit board so as to be thermally conductable, thereby discharging (dissipating) the heat generated by the driver element to the outside of the head holder.

SUMMARY

When the density of the recording elements of the recording head is increased as has recently been the case, the wiring pattern connecting the drive IC chip and the recording head is finer, and in order to suppress a voltage drop and noise caused thereby, it is necessary that the drive IC chip and the recording head be as close to each other as possible. Consequently, the heat generated by the drive IC chip is readily conducted to the actuator through the wiring board. This increases the temperature of the cavity unit that is in contact with the actuator. Consequently, the ink temperature increases as the image recording operation continues, so that the ink jetting characteristic gradually changes from the start of the recording operation to degrade image quality. In particular, the temperature of the ink in the head unit differs between the sides near and far from the drive IC chip, so that the ink jetting characteristic differs among the positions of the nozzles to degrade image quality.

An object is to provide a recording device in which a drive IC chip is mounted on a flexible flat cable, the recording device being capable of suppressing the increase in the temperature of the ink in the recording head due to the heat conducted from the drive IC chip and suppressing the degradation in image quality due to the temperature difference caused in the recording head.

In a recording device according to a first aspect provided with: a recording head having a plurality of recording elements and an actuator that includes a plurality of drive portions selectively driving the recording elements; a flexible flat cable having a wiring pattern that has one end electrically connected to the drive portions of the actuator and its other end connected to a signal source and a power source; a drive IC chip that is mounted on the flexible flat cable in a condition of being connected to the wiring pattern, and selectively supplies a drive voltage signal to the drive portions of the actuator; a first heat sink that is in contact with the drive IC chip so as to be thermally conductable; and a head holder containing the recording head, the flexible flat cable, the drive IC chip, and the first heat sink, a second heat sink is in contact with a wiring pattern formed portion of the flexible flat cable between the drive IC chip and the actuator so as to be thermally conductable.

According to the recording device of the first aspect, by the first heat sink that is directly in contact with the drive IC chip, the heat generated by the drive IC chip can be efficiently dissipated, and by the second heat sink being in contact, so as to be thermally conductable, with the wiring pattern formed portion of the flexible flat cable between the drive IC chip and the actuator, the conduction of the heat to the actuator can be minimized. Therefore, the increase in the temperature of the recording head can be suppressed. Consequently, the difference in the temperature of the ink in the recording head between the sides near and far from the drive IC chip is not large, so that the ink jetting characteristic of the recording device is substantially uniform and recording image quality is not degraded.

In a recording device according to a second aspect, in the first aspect, a base end of the second heat sink is fixed while sandwiching the flexible flat cable in a condition of being in contact, so as to be thermally conductable, with both obverse and reverse surfaces of the wiring pattern formed portion of the flexible flat cable between the drive IC chip and a part of the flexible flat cable which part is connected to the actuator. Therefore, of the heat generated by the drive IC chip, the heat transmitted to the wiring pattern formed portion of the flexible flat cable can be efficiently dissipated to the outside.

In a recording device according to a third aspect, in the first or second aspect, a part of the second heat sink is exposed to an outside of the head holder. Therefore, the head holder is never filled with heat and the ink jetting characteristic of the recording device is further stabilized, so that the effect of preventing the degradation in image quality is enhanced.

In a recording device according to a fourth aspect, in any of the first to third aspects, the second heat sink has a part extending substantially parallel to a side of the first heat sink that is in contact with the drive IC chip, and the flexible flat cable is passed between the parallelly extending part of the second heat sink and the side of the first heat sink. Therefore, the second heat sink can be disposed close to the first heat sink, so that the head holder, consequently, the recording device can be made compact.

In a recording device according to a fifth aspect, in any of the first to fourth aspects, the wiring pattern of the flexible flat cable between the drive IC chip and the actuator is bent so as to be longer than a shortest distance between the drive IC chip and the actuator along the flexible flat cable, and the bent portion is in contact with the second heat sink. Consequently, the heat transmitted to the recording head through the wiring pattern with particularly excellent thermal conductivity of the flexible flat cable can be suppressed, and the efficiency of the conduction of the heat to the second heat sink can be made more excellent.

The above and further objects and features of the invention will more fully be apparent from the following detailed description with accompanying drawings.

DETAILED DESCRIPTION OF THE EXEMPLARY EMBODIMENTS

Hereinafter, embodiments will be described with reference to the drawings.

Figure 1:
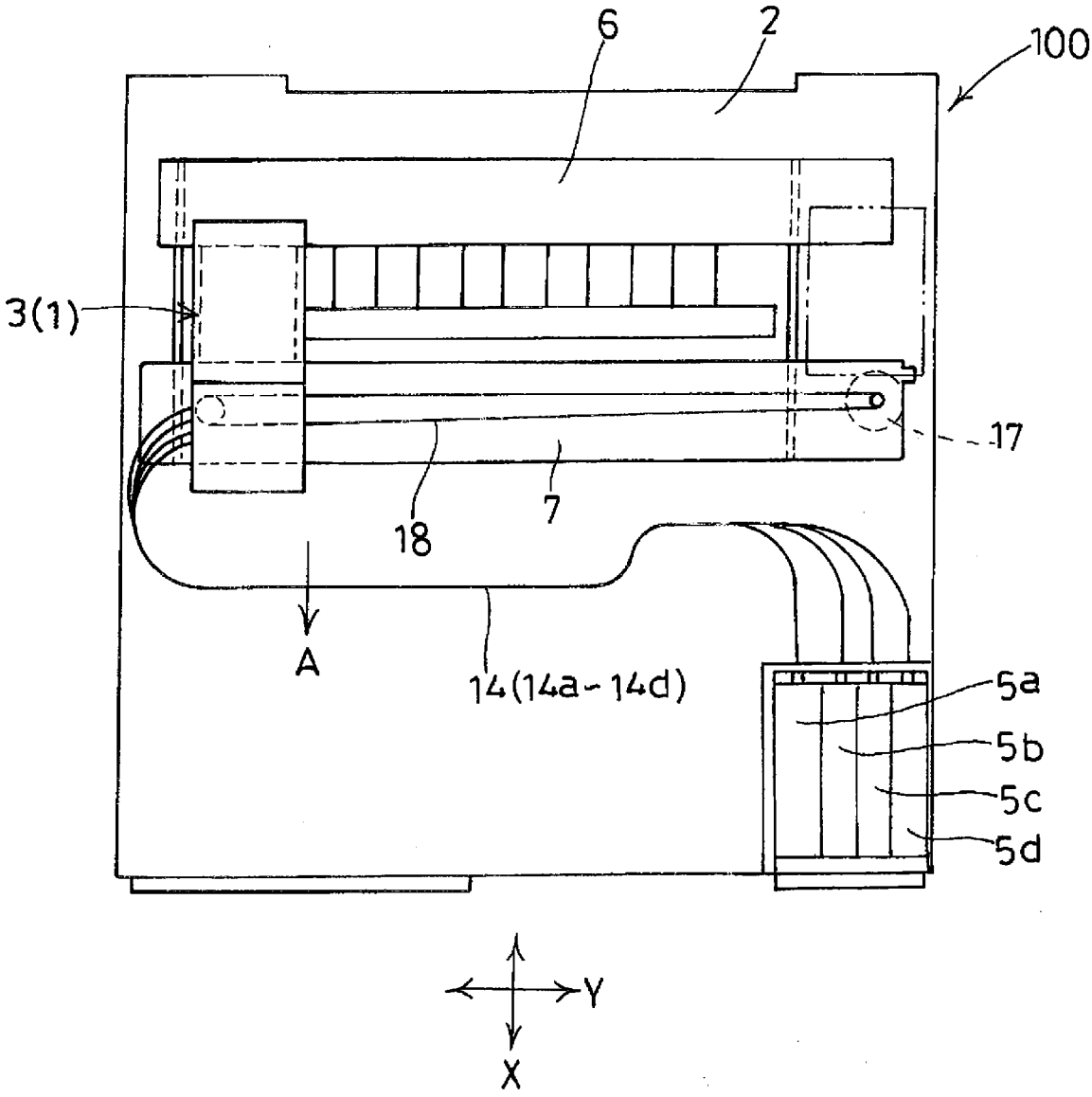
FIG. 1 is a schematic plan view of an inkjet recording device.

FIG. 1 shows an example in which the recording device is applied to an inkjet recording device 100. The inkjet recording device 100 is applicable, for example, not only as a discrete printer device but also as a printer function of a multi function device (MFD) having a copy function, a scanner function, a facsimile function and the like. The inkjet recording device 100 comprises a recording head 1, which is provided inside a body frame 2 and performs recording by jetting ink onto a sheet (not shown) as a recording medium. The recording head 1 is mounted on the lower surface side of a carriage 3 and travels in the main scanning direction (Y direction).

Figure 2:
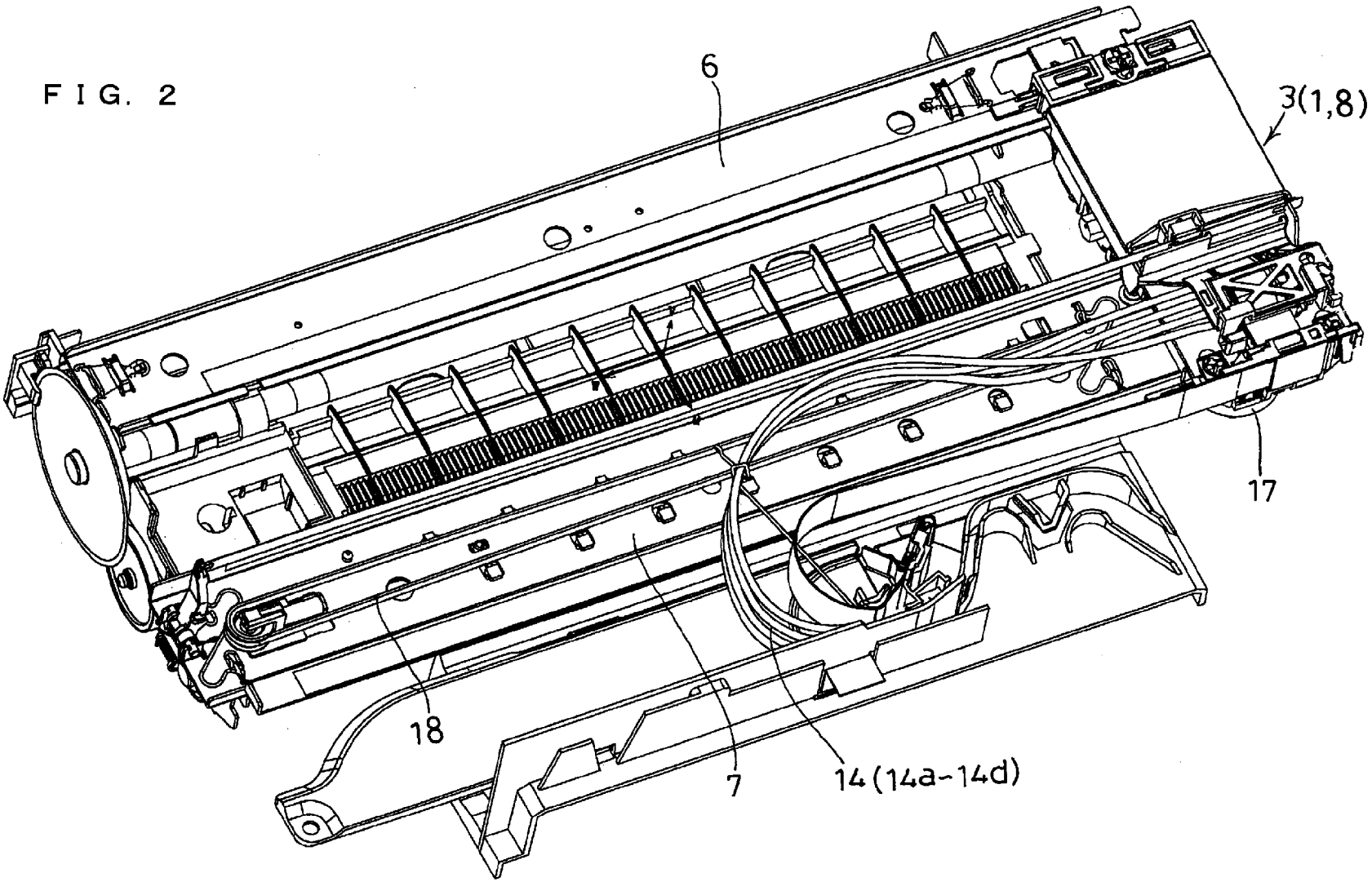
FIG. 2 is a perspective view of an internal mechanism of the inkjet recording device.

As shown in FIGS. 1 and 2, the carriage 3 is placed so as to be slidable on a first (upstream side) guide plate 6 and a second (downstream side) guide plate 7 provided parallel to each other in the main scanning direction (Y direction) in a frame provided inside the body frame 2. The carriage 3 is reciprocated in the main scanning direction (Y direction) by a carriage drive motor 17 disposed on the right side of the lower surface of the second guide plate 7 and a timing belt 18 which is an endless belt. Ink is supplied to the carriage 3 from ink supply sources (ink tanks) 5*a* to 5*d* disposed inside the body frame 2 through an ink supply tube 14 (14*a* to 14*d*). In this embodiment, four colors of inks, yellow ink (Y), magenta ink (M), cyan ink (C), and black ink (Bk), are provided.

The sheet is horizontally conveyed on the lower surface side of the recording head 1 by a non-illustrated known sheet conveyance mechanism in a sub scanning direction (X direction) perpendicular to the main scanning direction (Y direction) (the direction of the arrow A in FIG. 1). Recording is performed by ink being jetted downward onto the sheet from nozzles (not shown) opened on the lower surface of the recording head 1 moving in the main scanning direction (Y direction). In the description, the nozzle opened surface side of the recording head 1 will be referred to as the front or lower surface and the side opposite thereto, as the back or upper surface thereof.

Figure 3:
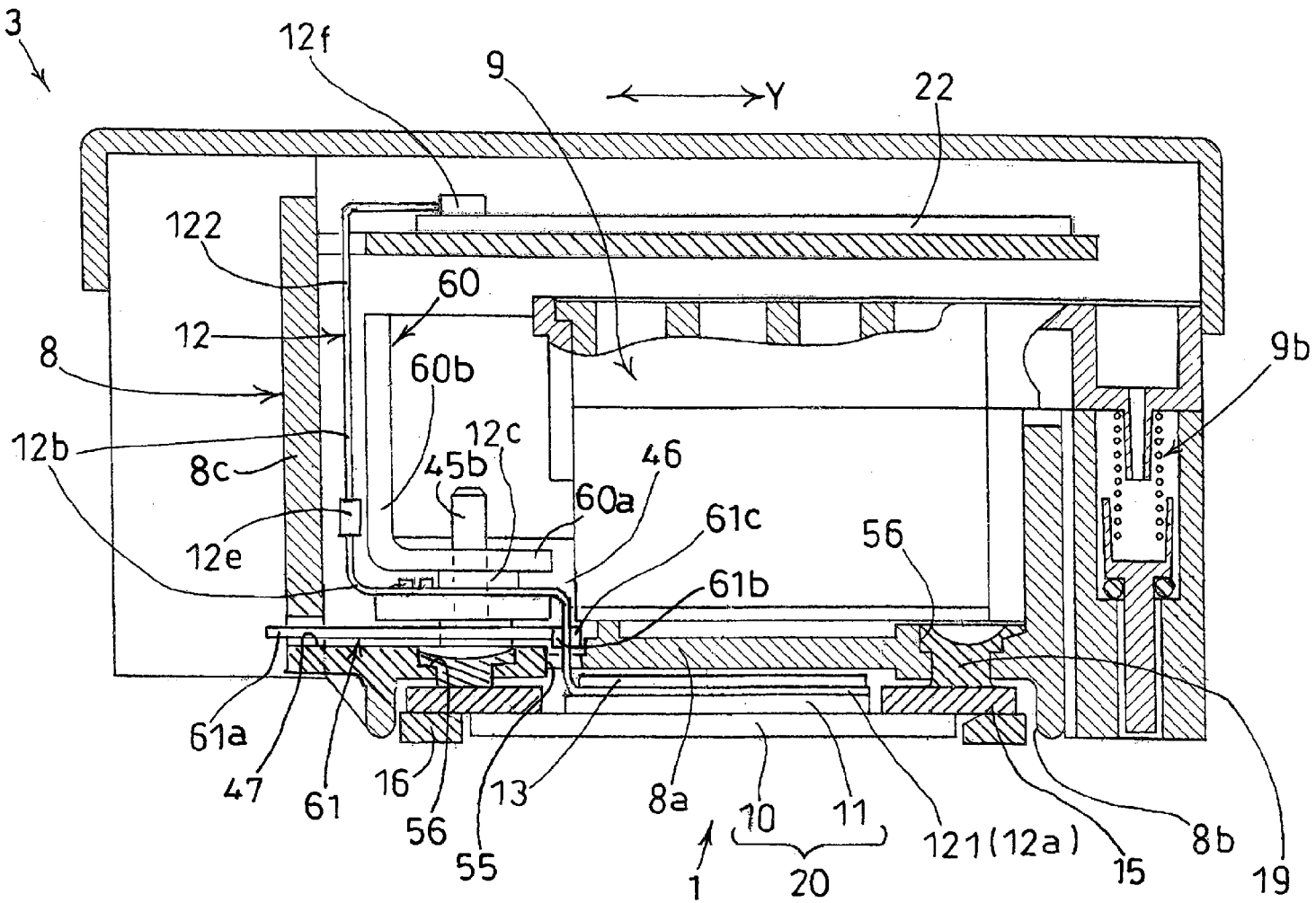
FIG. 3 is a cross-sectional view of a carriage taken along a Y direction.

The carriage 3 has, as shown in FIG. 3, a substantially box-shaped head holder 8. In a concave portion 8*b* opened downward on the bottom side of a bottom plate 8*a* of the head holder 8, the recording head 1 is fixed substantially parallel to the bottom plate 8*a* so that the nozzles are exposed downward (see FIG. 3).

A circuit board 22 is disposed on the back side of the head holder 8. The head side circuit board 22 is disposed in a position overlapping the recording head 1 when viewed two-dimensionally from the back side of the head holder 8. The circuit board 22 is electrically connected to a body side board (not shown) disposed inside the body frame 2 through a flexible wiring member, and the data of the recorded image and the driving voltage is supplied.

A damper 9 that stores the inks supplied from the ink tanks 5*a* to 5*d* is provided on the upper surface side of the bottom plate 8*a* of the head holder 8 between the recording head 1 and the circuit board 22. The inside of the damper 9 is partitioned into a plurality of ink chambers, and the inks are stored in such a manner that the ink of one color is stored in one ink chamber. The damper 9 has exhaust valve means 9*b* for removing the bubbles remaining in the inks in the ink chambers.

In the bottom plate 8*a* of the head holder 8, an opening (not shown) is formed so as to pass therethrough. Inside the opening, ink outlets 9*a* of the damper 9 and ink inlets 37 of the recording head 1 are connected through connection holes 15*b* of a reinforcing frame 15 and a non-illustrated elastic sealing member. The ink of each color is independently supplied from the damper 9 to the recording head 1 (see FIGS. 3 and 4). As shown in FIGS. 2 and 3, a slit 55 through which a flexible portion 12*b* of a flexible flat cable 12 described later is passed from the front side (lower surface side) to the back side (upper surface side) and a through hole 56 for pouring an adhesive agent 19 for fixing the recording head 1 to the front side (lower surface side) of the bottom plate 8*a* are formed in the bottom plate 8*a* of the head holder 8.

The recording head 1 has a head unit 20 having a structure in which a cavity portion 10 having a plurality of nozzles opened at the lower surface and having ink paths inside, an actuator 11 that selectively applies a jetting pressure to the inks in the cavity portion 10, and the flexible flat cable 12 that outputs a drive signal to the actuator 11 are placed one on another. The recording head 1 also has a thermally conducting plate 13 and the reinforcing frame 15 on the back side of the head unit 20, and has a front frame 16 surrounding the periphery.

Figure 5:
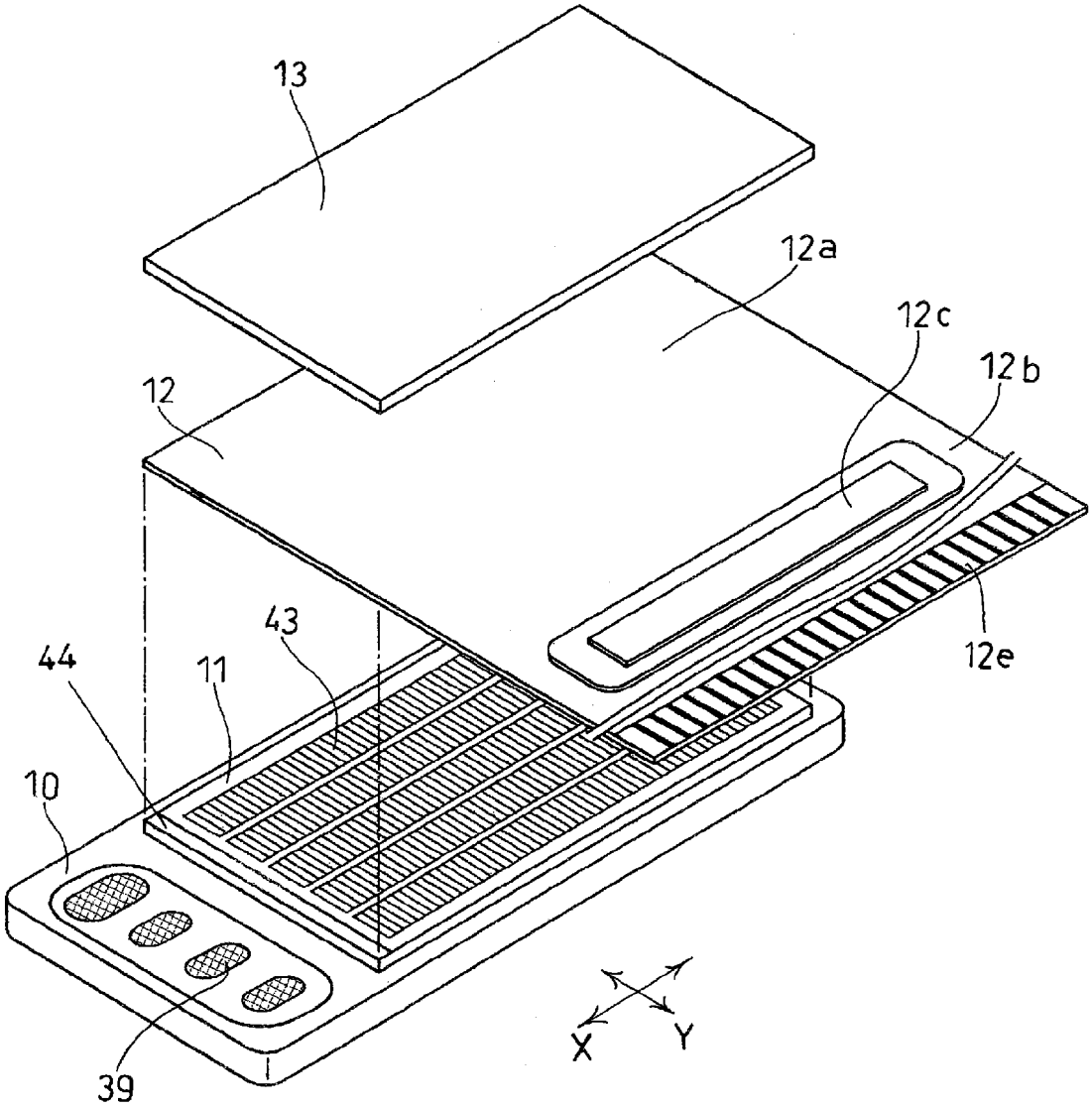
FIG. 5 is an exploded perspective view of a recording head.

In the cavity portion 10, like the known ones in Japanese Patent Application Laid-Opens Nos. 2005-313428 and 2005-322850, the inks individually supplied to the ink inlets 37 exposed on one end, in the X direction, of the upper surface of the cavity portion 10 are distributed to a multiplicity of pressure chambers (none is shown) through manifold chambers. Then, drive portions of the actuator 11 are driven to selectively apply the jetting pressure to pressure chambers, whereby inks are jetted from the nozzles communicating with the pressure chambers. Filter members 39 which prevent bubbles from flowing into the cavity portion 10 and cause only inks to pass are attached to the ink inlets 37 (see FIG. 5).

In this embodiment, the actuator 11 has, like the known one disclosed in Japanese Patent Application Laid-Open No. 2005-322850, a plurality of ceramic layers laminated in a direction perpendicular to the flat direction and internal electrodes (not shown) sandwiched between the ceramic layers. The drive portions, that is, the active portions are formed in a region of the ceramic layers vertically sandwiched by the internal electrodes. External individual electrodes 43 connected to, of the internal electrodes, electrodes independent for each of the pressure chambers through an electric through hole and an external common electrode 44 connected to the internal electrode common to the pressure chambers are formed on the upper surface of the actuator 11 (see FIG. 5). The active portions are displaced by a drive pulse signal applied to the external individual electrodes 43, whereby the jetting pressure is selectively applied to the multiplicity of pressure chambers. The external individual electrodes 43 are individually electrically connected to terminal electrodes 12*d* formed on the flexible flat cable 12 (see FIG. 6), and the external common electrode 44 is electrically connected to a common potential line COM formed on the flexible flat cable 12.

The reinforcing frame 15 is a member for reinforcing the cavity portion 10. The reinforcing frame 15 has a frame-shaped member made of a material that is more excellent in rigidity than the cavity portion 10 (for example, a plate of a metal such as SUS), and its outer dimensions are a size larger than those of the cavity portion 10 when viewed two-dimensionally. The reinforcing frame 15 is placed and bonded so as to surround the actuator 11 along the back surface of the cavity portion 10 to thereby prevent the deformation and distortion of the thin and flat cavity portion 10. The connection holes 15*b* corresponding to the ink inlets 37 of the cavity portion 10 are formed on one end, in the X direction, of a frame portion 15*a* of the reinforcing frame 15 so as to pass through the reinforcing frame 15.

The thermally conducting plate 13 is placed in a position corresponding to the actuator 11 on the back surface of the flexible flat cable 12. The thermally conducting plate 13 is a flat plate member that is rectangular when viewed two-dimensionally, and has a size corresponding to the entire area of the actuator 11. The thermally conducting plate 13 is made of a material that is more excellent in thermal conductivity than the actuator 11 and the flexible flat cable 12 and higher in rigidity than the flexible flat cable 12. For example, a plate of a metal such as aluminum, copper, or SUS is appropriate. The thermally conducting plate 13 is in intimate contact with the actuator 11 through the flexible flat cable 12, thereby producing the effect of decentralizing the local heat generation of the actuator 11 to suppress unevenness in temperature distribution and the effect of dissipating heat. Further, the thermally conducting plate 13 produces the effect of enhancing the overall rigidity of the head unit 20. The thermally conducting plate 13 is sometimes omitted.

The front frame 16 formed of a flat plate member that is square-frame-shaped when viewed two-dimensionally is disposed so as to surround the cavity portion 10, and fixed to the front surface of the reinforcing frame 15. The level difference between the nozzle surface of the cavity portion 10 and the periphery of the head holder 8 is removed by the front frame 16 to prevent a sweeping member or the like from being caught by the level difference when the nozzle surface is cleaned by the sweeping member or the like.

The flexible flat cable 12 has flexibility as a whole, and is belt-shaped. One end of the flexible flat cable 12 is a flat portion 12*a* joined to the actuator 11, and the other end that is continuous with the flat portion 12*a* is the flexible portion 12*b*. At the flat portion 12*a*, a plurality of terminal electrodes 12*d* for electrical connection to the external individual electrodes 43 and the external common electrode 44 are formed on, of the upper and lower surfaces (obverse and reverse surfaces) of the flexible flat cable 12, the lower surface opposite to the actuator 11 (see FIG. 6).

At the flexible portion 12*b*, a drive IC chip 12*c* for driving the actuator 11 is mounted on the upper surface (the surface opposite to the lower surface where the terminal electrodes 12*d* are formed) of the flexible flat cable 12. Further, circuit elements other than the drive IC chip 12*c*, such as capacitors and resistors, may be provided. The end of the flexible portion 12*b* is connected to the circuit board 22 by a connection terminal 12*f*.

Figure 6:
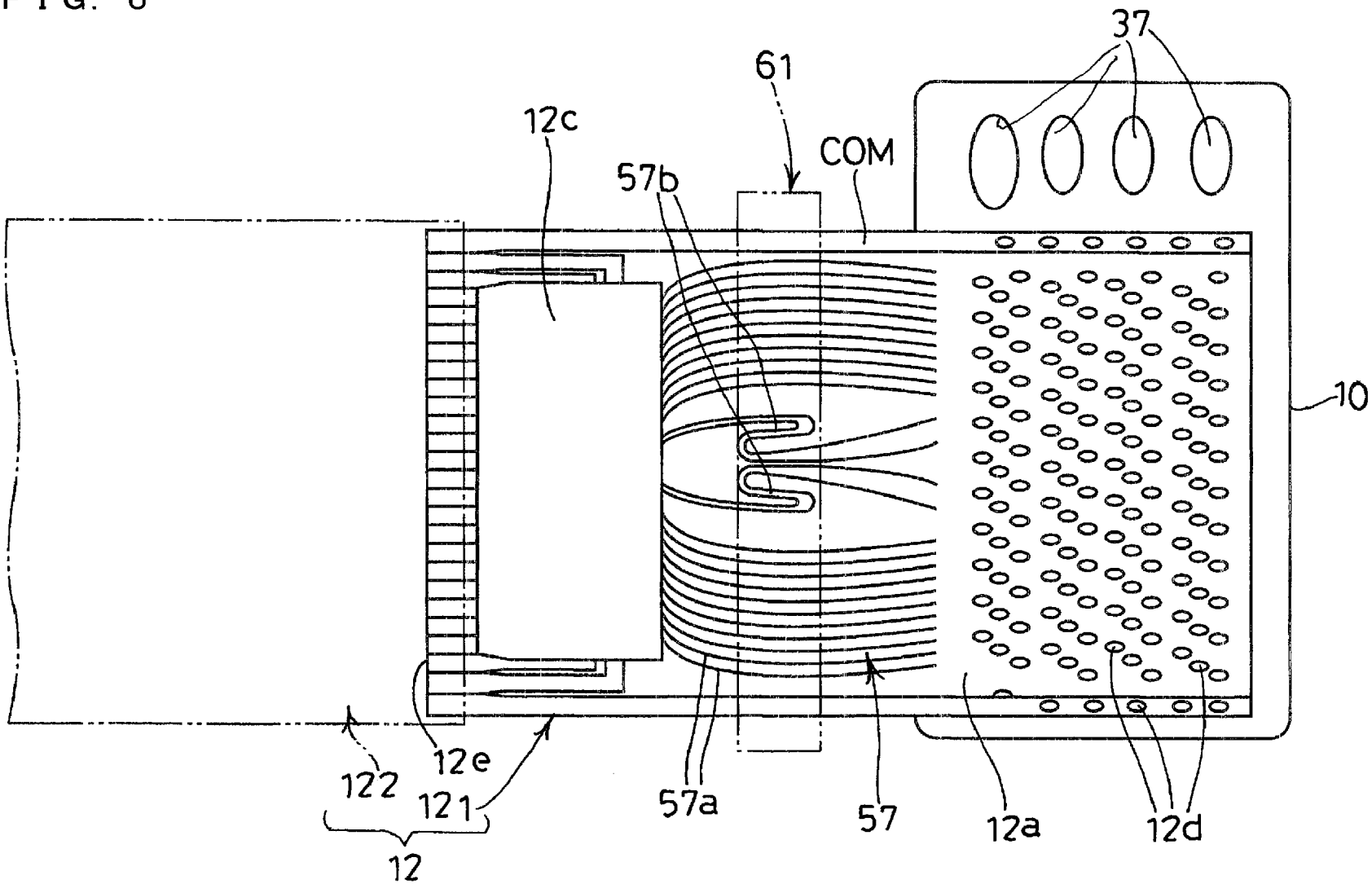
FIG. 6 is a plan view of a flexible flat cable and a recording head.

The flexible flat cable 12 may be formed of one continuous cable. In this embodiment, the flexible flat cable 12 has a structure in which two cables, a first cable 121 and a second cable 122, are coupled together through a connection terminal 12*e* in the direction of length (see FIG. 6). As shown in FIG. 6, on the first cable 121, the terminal electrodes 12*d* electrically connected to the actuator 11, the common potential line COM, and a wiring pattern 57*a* for connection to the drive IC chip 12*c* are printed on an insulating film. The second cable 122 is a general-purpose cable having a plurality of wiring patterns (not shown) in parallel. The drive IC chip 12*c* is mounted on a part extended from the flat portion 12*a* of the first cable 121, that is, on the flexible portion 12*b*. Therefore, while the flat portion 12*a* is provided only on the first cable 121, the flexible portion 12*b* includes both the first and second cables 121 and 122.

A first heat sink 60 and a second heat sink 61 are provided. The first heat sink 60 is in contact with the drive IC chip 12*c* so as to be thermally conductable, and the second heat sink 61 is in contact with a wiring pattern formed portion 57 (which is also the flexible portion 12*b*) of the first cable 121 of the flexible flat cable 12 between the drive IC chip 12*c* and the actuator 11 so as to be thermally conductable. The first and second heat sinks 60 and 61 are both formed of a metal plate with high thermal conductivity.

Figure 4:
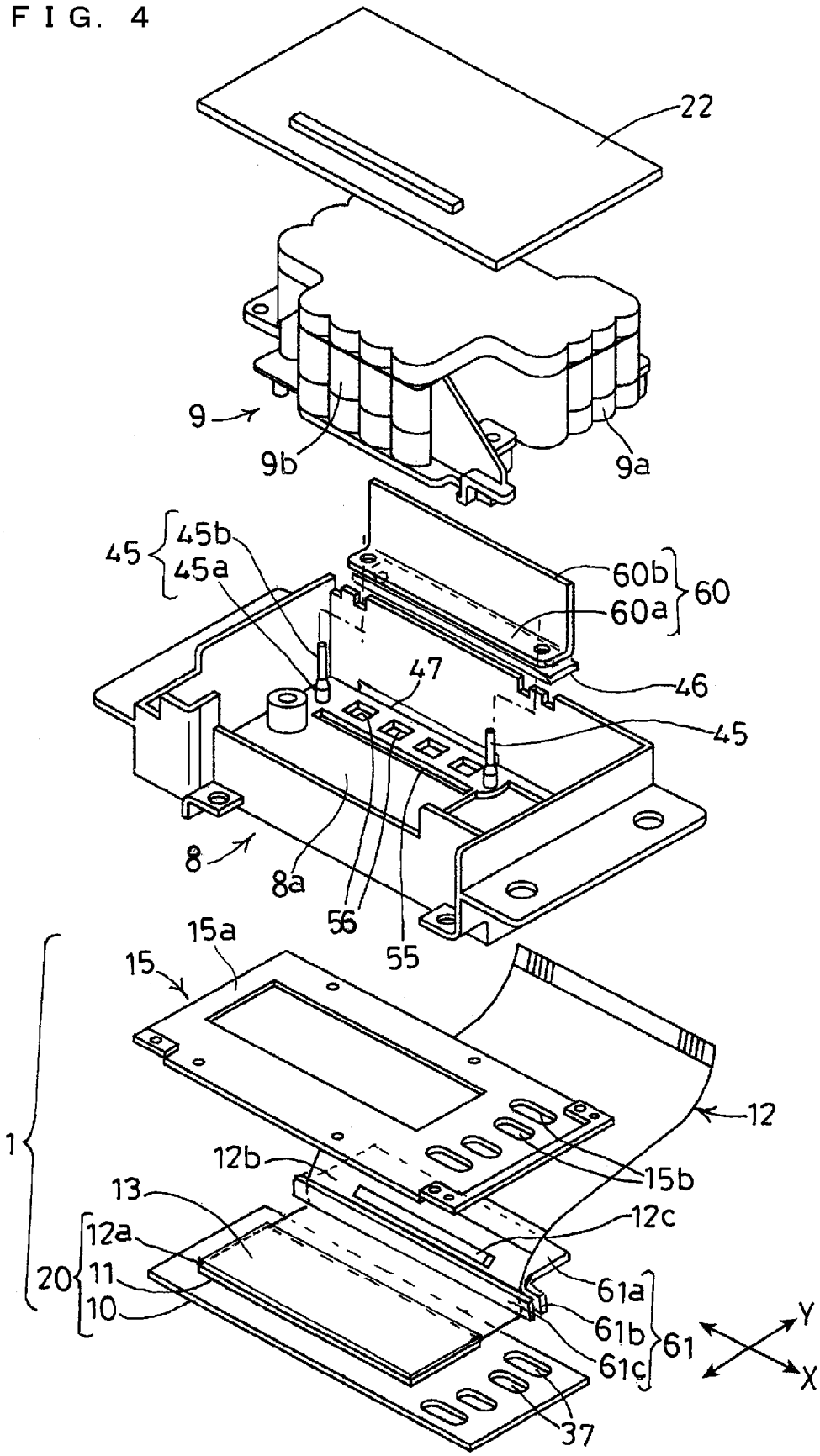
FIG. 4 is an exploded perspective view of a head holder and its inside.

As shown in FIGS. 3 and 4, the flexible portion 12*b* of the flexible flat cable 12 is passed from the front side (lower surface side) to the back side (upper surface side) through the slit 55 formed on the bottom plate 8*a* of the head holder 8 so as to be elongated in the X direction. A pair of support shafts 45 are provided in a standing condition on the upper surface side of the bottom plate 8*a* of the head holder 8 adjoining the slit 55. As shown in FIG. 4, the support shafts 45 are each formed so that the diameter of a lower end portion 45*a* is large and the diameter of an inserted shaft portion 45*b* on the upper side is small. The inserted shaft portions 45*b* are passed through the insertion holes on both ends of a support plate 46 made of an insulating material so that the support plate 46 is supported on the lower end portions 45*a*, whereby the support plate 46 is horizontally laid between the pair of support shafts 45. The flexible flat cable 12 is placed on the upper surface of the support plate 46 in such a manner that the drive IC chip 12*c* is placed on the upper surface.

The first heat sink 60 made of a metal with excellent thermal conductivity is bent so that a horizontal bottom plate portion 60*a* and a vertical side plate portion 60*b* form an L shape when viewed from a side. The bottom plate portion 60*a* is disposed parallel to the bottom plate 8*a*, and the side plate portion 60*b* stands in parallel at a distance from a side wall 8*c* of the head holder 8 opposed thereto in the Y direction. Holes through which the inserted shaft portions 45*b* of the pair of support shafts 45 can pass are provided in the bottom plate portion 60*a*. The bottom plate portion 60*a* is structured so as to be thermally conductable by the upper surface of the drive IC chip 12*c* being in contact with the lower surface of the bottom plate portion 60*a*.

The second heat sink 61 has: an L-shaped member including a heat dissipating portion 61*a* extending in a horizontal direction and a thin-belt-form base portion 61*b* extending downward from the base end of the heat dissipating portion 61*a*; and a fixing member 61*c* having a thin belt form as well and opposed to the base portion 61*b*. The base portion 61*b* is in contact with one surface of the wiring pattern formed portion 57 in a part of the flexible flat cable 12 between the drive IC chip 12*c* and a portion of the flexible flat cable 12 connected to the actuator 11. The second heat sink 61 is fixed with the flexible flat cable 12 sandwiched between the base portion 61*b* and the fixing member 61*c* opposed to the base portion 61*b*, and is in contact with both the obverse and reverse surfaces of the flexible flat cable 12 so as to be thermally conductable.

In the embodiment, as shown in FIG. 3, both the obverse and reverse surfaces of the wiring pattern formed portion 57 of the flexible flat cable 12 are sandwiched between the base portion 61*b* and the fixing member 61*c* of the second heat sink 61 on the upper surface side of the bottom plate 8*a* of the head holder 8 adjoining the slit 55, and are fixed with an adhesive agent having thermal conductivity or the like. They may be fixed with both ends of the base portion 61*b* and the fixing member 61*c* fastened by a non-illustrated clip. The horizontal heat dissipating portion 61*a* of the second heat sink 61 extends parallel to the upper surface side of the bottom plate 8*a* to be exposed to the outside of the head holder 8 through a perforated groove 47 formed in the side wall 8*c* of the head holder 8 (see FIG. 3). The perforated groove 47 is formed so that the heat dissipating portion 61*a* can pass between the pair of support shafts 45.

Then, the support plate 46 is placed on the lower portions 45*a* of the pair of support shafts 45. Then, the flexible flat cable 12 is placed on the upper surface of the support plate 46, the pair of support shafts 45 are passed through the holes of the bottom plate portion 60*a*, and the first heat sink 60 is placed. Thereby, the bottom plate portion 60*a* is in contact with the upper surface of the drive IC chip 12*c*, and the heat generated by the drive IC chip 12*c* is conducted to the side plate portion 60*b* through the bottom plate portion 60*a* and dissipated. The support plate 46 functions as a back plate for bringing the drive IC chip 12*c* into direct contact with the bottom plate portion 60*a* of the first heat sink 60. The first heat sink 60 is fixed by crushing the upper ends of the support shafts 45 while heating it or by pouring an adhesive agent between the support shafts 45 and the holes of the bottom plate portion 60*a*. While the second heat sink 61 may be pressed against the bottom plate 8*a* of the head holder 8 by the first heat sink 60, it may be fixed onto the bottom plate 8*a* by an adhesive agent.

In the embodiment, the heat generated by the drive IC chip 12*c* is efficiently dissipated through the first heat sink 60, and the heat transmitted from the drive IC chip 12*c* to the actuator 11 through the flexible portion 12*b* is efficiently intercepted and dissipated to the outside of the head holder 8. To realize this, the second heat sink 61 has a part (heat dissipating portion 61*a*) extending substantially parallel to the side (bottom plate portion 60*a*) of the first heat sink 60 that is in contact with the drive IC chip 12*c*, and the flexible flat cable 12 is passed between the parallelly extending part (heat dissipating portion 61*a*) of the second heat sink 61 and the side (bottom plate portion 60*a*) of the first heat sink 60. With this structure, the second heat sink 61 can be disposed close to the first heat sink 60, so that the head holder 8, consequently, the recording device can be made compact.

The support plate 46 may be formed of an elastic member having a thermal shield capacity such as a rubber plate. By doing this, the support plate 46 serves as a backing member that enhances the adhesion between the drive IC chip 12*c* and the bottom plate portion 60*a* so that the drive IC chip 12*c* is pressed against the bottom plate portion 60*a* to be in contact therewith so as to be thermally conductable with reliability.

Moreover, as shown in FIG. 6, a bend formed portion 57*b* may be formed in the wiring pattern formed portion 57 of the flexible flat cable 12 between the drive IC chip 12*c* and the actuator 11. That is, the wiring pattern is bent so as to be longer than the shortest distance between the drive IC chip 12*c* and the actuator 11 along the flexible flat cable 12. Since the wiring pattern is more excellent in thermal conductivity than the insulating film of the flexible flat cable 12, the wiring pattern is prolonged to suppress thermal conduction. In particular, since the temperature of the circuit portion within the drive IC chip 12*c* corresponding to a highly frequently used nozzle is high, by forming the wiring pattern extending therefrom like this, the thermal conduction from the drive IC chip 12*c* can be suppressed. By bringing the second heat sink 61 into contact with such a bend formed portion 57*b*, the efficiency of the thermal conduction to the second heat sink 61 is further improved.

Figure 7:
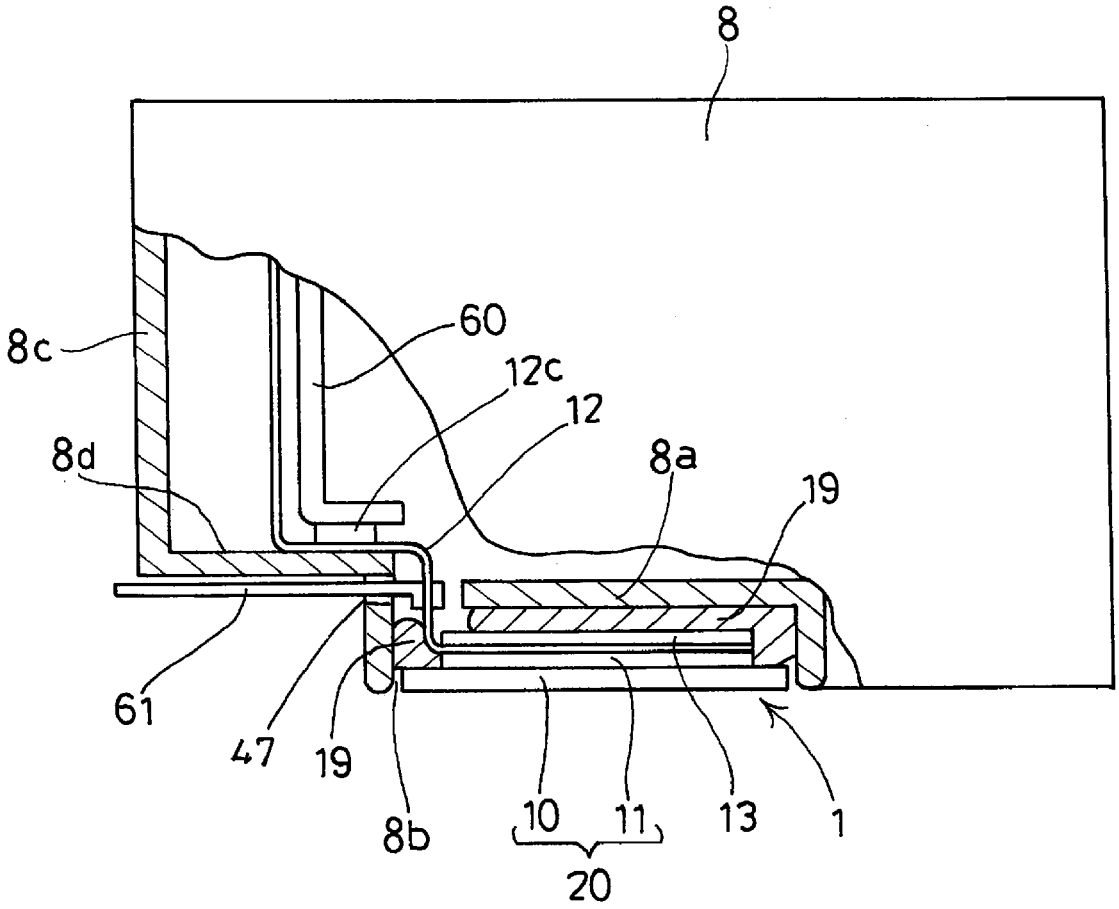
FIG. 7 is a partially cross-sectional view of a carriage in another embodiment taken in the Y direction.

FIG. 7 shows another embodiment in which the recording head 1 is not provided with the reinforcing frame 15 and the adhesive agent 19 is filled between the head unit 20 and the lower surface of the bottom plate 8*a* to thereby fix the recording head 1 to the head holder 8. In this case, the second heat sink 61 is exposed more than in the above-described embodiment from the perforated groove 47 provided in the side wall of the concave portion 8*b* accommodating the recording head 1 along a lower side of a bottom outer wall 8*d* of the head holder 8 situated below the first heat sink 60, so that a higher heat dissipating effect can be obtained. It is preferable that the second heat sink 61 be bonded to the lower surface of the bottom outer wall 8*d* or the like.

While an example in which the above embodiments are applied to an inkjet recording device is described above, the present invention is applicable to various kinds of recording devices such as impact recording devices as long as they have a plurality of recording elements and corresponding drive portions.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A recording device comprising:

a recording head having a plurality of recording elements and an actuator that includes a plurality of drive portions selectively driving the recording elements;

a flexible flat cable having a wiring pattern that has one end electrically connected to the drive portions of the actuator and its other end connected to a signal source and a power source;

a drive IC chip that is mounted on the flexible flat cable in a condition of being connected to the wiring pattern, and selectively supplies a drive voltage signal to the drive portions of the actuator;

a first heat sink that is in contact with the drive IC chip so as to be thermally conductable;

a head holder containing the recording head, the flexible flat cable, the drive IC chip, and the first heat sink; and a second heat sink that is in contact with a wiring pattern formed portion of the flexible flat cable between the drive IC chip and the actuator so as to be thermally conductable, wherein a base end and a fixing member of the second heat sink sandwiches the flexible flat cable in a condition of being thermally conductable and the second heat sink is in contact with both obverse and reverse surfaces of the wiring pattern formed portion of the flexible cable between the drive IC chip and a portion of the flexible cable connected to the actuator.

2. The recording device according to claim 1, wherein a part of the second heat sink is exposed to an outside of the head holder.

3. The recording device according to claim 1, wherein the second heat sink has a part extending substantially parallel to a side of the first heat sink that is in contact with the drive IC chip, and the flexible flat cable is passed between the parallelly extending part of the second heat sink and the side of the first heat sink.

4. A recording device comprising:

a recording head having a plurality of recording elements and an actuator that includes a plurality of drive portions selectively driving the recording elements;

a flexible flat cable having a wiring pattern that has one end electrically connected to the drive portions of the actuator and its other end connected to a signal source and a power source;

a drive IC chip that is mounted on the flexible flat cable in a condition of being connected to the wiring pattern, and selectively supplies a drive voltage signal to the drive portions of the actuator;

a first heat sink that is in contact with the drive IC chip so as to be thermally conductable;

a head holder containing the recording head, the flexible flat cable, the drive IC chip, and the first heat sink; and a second heat sink that is in contact with a wiring pattern formed portion of the flexible flat cable between the drive IC chip and the actuator so as to be thermally conductable, wherein the wiring pattern of the flexible flat cable between the drive IC chip and the actuator is bent so as to be longer than a shortest distance between the drive IC chip and the actuator along the flexible flat cable, and the bent portion is in contact with the second heat sink.

5. The recording device according to claim 4, wherein a part of the second heat sink is exposed to an outside of the head holder.

6. The recording device according to claim 4, wherein the second heat sink has a part extending substantially parallel to a side of the first heat sink that is in contact with the drive IC chip, and the flexible flat cable is passed between the parallelly extending part of the second heat sink and the side of the first heat sink.

* * * * *